United States Patent [19]

Hochman

[11] 4,114,763

[45] Sep. 19, 1978

[54] COMPOSITE UNITS FOR DISPLAYING MERCHANDISE

[75] Inventor: Arthur Hochman, Union City, N.J.

[73] Assignee: Art-Phyl Creations, Newark, N.J.

[21] Appl. No.: 660,757

[22] Filed: Feb. 24, 1976

Related U.S. Application Data

[63] Continuation-in-part of Ser. No. 480,344, Jun. 18, 1974, Pat. No. 3,939,985.

[51] Int. Cl.[2] ..... A47F 5/04; A47F 7/00

[52] U.S. Cl. ..... 211/57.1; 211/59.1; 211/107; 248/159

[58] Field of Search ..... 211/7, 57, 53, 54, 56, 211/59, 58, 163, 165, 166, 107, 110, 194, 205, 70, 95, 111, 112, 129, 131, 164, 208, 182, 188; 248/DIG. 3, 159; 403/300, 305, 306

[56] References Cited

U.S. PATENT DOCUMENTS

| | | | |
|---|---|---|---|
| 262,908 | 8/1882 | Philbrick | 211/166 |
| 341,806 | 5/1886 | Hitchcock et al. | 211/57 |
| 504,916 | 9/1893 | Frankel | 211/59 X |
| 810,829 | 1/1906 | Ward | 211/59 |
| 1,149,691 | 8/1915 | Seamans | 211/59 |
| 1,306,297 | 6/1919 | Auerochs | 211/59 X |
| 1,306,297 | 6/1919 | Auerochs | 211/59 X |
| 1,824,682 | 9/1931 | O'Neil | 248/159 X |
| 1,890,420 | 12/1932 | Smith | 211/188 |
| 2,692,054 | 10/1954 | Berglund | 248/303 X |
| 2,842,264 | 7/1958 | Larson | 248/DIG. 3 X |
| 3,158,264 | 11/1964 | Bittner et al. | 211/166 X |
| 3,194,403 | 7/1965 | Van Horn | 211/107 X |
| 3,198,338 | 8/1965 | McCormick | 211/163 X |
| 3,319,800 | 5/1967 | Bowles | 211/163 |
| 3,374,898 | 3/1968 | Karmin | 211/159 |
| 3,435,959 | 4/1969 | Berman et al. | 211/163 |
| 3,788,489 | 1/1974 | Levinthal | 211/163 |
| 3,815,756 | 6/1974 | Cox | 211/157 |
| 3,939,985 | 2/1976 | Hochman | 211/57 |

FOREIGN PATENT DOCUMENTS

| | | | |
|---|---|---|---|
| 1,571,382 | 5/1969 | France | 211/57 |
| 2,206,067 | 8/1973 | Fed. Rep. of Germany | 211/107 |

*Primary Examiner*—Thomas J. Holko

*Attorney, Agent, or Firm*—Blum, Moscovitz, Friedman & Kaplan

[57] ABSTRACT

Improved composite units for displaying merchandise are provided generally comprising a rack having hook members releasably mounted thereon. A safety bumper guard may be connected to the rack to prevent an inadvertent encounter with a hook member of the display that may otherwise result in injury to a pedestrian shopper. The safety bumper guard is releasably connectable to the rack, extends beyond and surrounds the free ends of hook members mounted thereon. Goods packaged in blister packs and wrappers with headers may, for example, be removably mounted on the hook members. According to one embodiment of the invention, the rack is vertically adjustable in a pair of substantially parallel upright channel members. A plurality of the racks may be simultaneously mounted in the channel members. According to another embodiment of the invention, a first rack is demountably connectable to an upright sleeve in substantially fixed position relative thereto and a plural number of additional racks may be respectively nested one in another thereon, thereby providing a stacked display.

4 Claims, 10 Drawing Figures

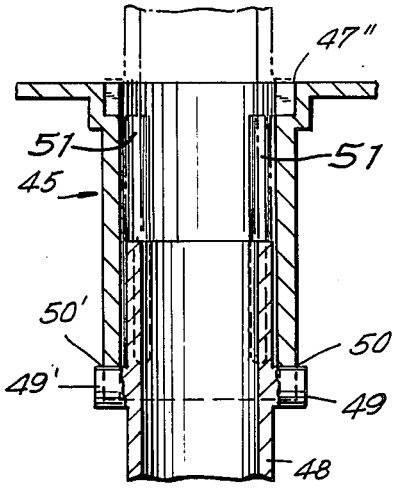
FIG.7
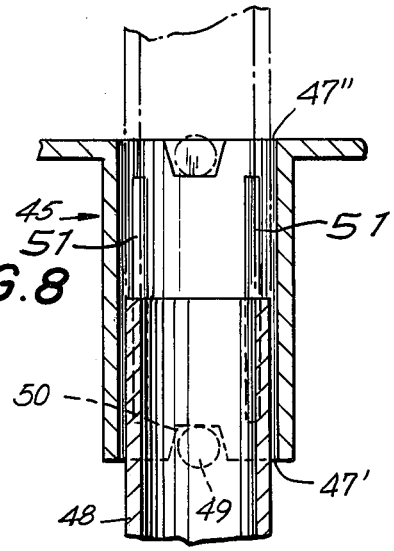
FIG.8
FIG.9
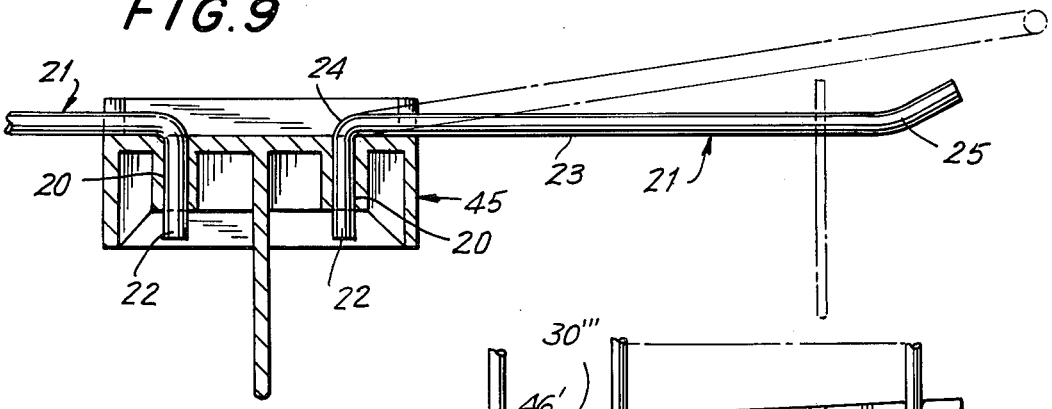
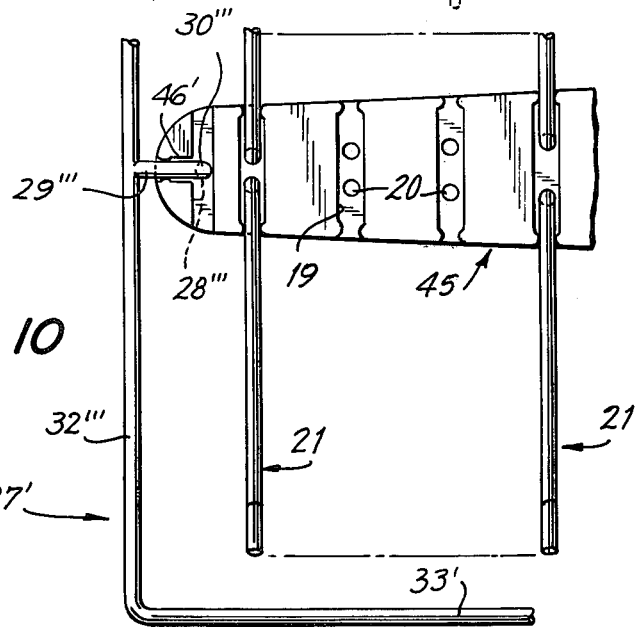
FIG.10

COMPOSITE UNITS FOR DISPLAYING MERCHANDISE

CROSS REFERENCE TO RELATED APPLICATIONS

This application is a continuation-in-part application of application Ser. No. 480,344, filed June 18, 1974 for Improved Hook Display Assembly, now U.S. Pat. No. 3,939,985, copending herewith.

BACKGROUND OF THE INVENTION

The instant invention relates to improved composite units for displaying merchandise, and more particularly to rack and hook display units having novel constructions, these constructions being adapted to include the safety feature disclosed in my copending application Ser. No. 480,344, filed June 18, 1974 for Improved Hook Display Assembly, now U.S. Pat. No. 3,939,985, which is incorporated herein by reference.

Goods packaged in blister packs and wrappers with headers are, for instance, conveniently displayed on units within the scope of the instant invention. These units provide means for displaying a multiplicity of packaged goods on a minimum amount of floor space. Commercially available space in supermarkets and like retail establishments may be, therefore, maximized by liberal use of these units, particularly in heavily trafficked areas of the store.

These units are portable, easily installed and broken down. Each unit is adapted to include a safety construction feature which substantially eliminates any possibility of customer injury by inadvertent engagement against the free standing display hooks mounted in the units.

SUMMARY OF THE INVENTION

Generally speaking, in accordance with the invention, improved composite units for displaying merchandise are provided generally comprising a rack having hook members releasably mounted thereon. Goods packaged in blister packs and wrappers with headers may, for instance, be removably mounted on the hook members.

The rack includes means for connecting a safety bumper guard thereto for the purpose of preventing inadvertent encounters with the hook members mounted in the display which may otherwise be the instrument of injury to an unawares or careless pedestrian shopper. The safety bumper guard is releasably conectable to the rack, extends beyond and surrounds the free ends of hook members mounted thereon.

According to one embodiment of the invention, the rack is vertically adjustable in a pair of substantially parallel upright channel members. A plurality of the racks may be simultaneously movably mounted in the channel members.

According to another embodiment of the invention, a first rack is demountably connectable to an upright sleeve in substantially fixed position relative thereto. A plural number of additional racks may be respectively nested one on another, the first rack providing a support for the nested series, which comprises a stacked composite display unit.

Accordingly, it is an object of this invention to provide improved composite units having novel constructions for displaying merchandise.

Another object of the invention is to provide display units in which display racks may be variably stacked.

A further object of the invention is to provide composite display units having a safety oriented construction, which does not impair the sales value of the display but does substantially prevent injury that otherwise may be caused thereby.

Yet another object of the invention is to provide portable display units which are easily installed and broken down.

Still other objects and advantages of the invention will, in part, be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 7 is a sectional view of the assembly seen in FIG. 4, the section being taken along line 7—7 thereof;

FIG. 8 is a sectional view of the assembly seen in FIG. 4, the section being taken along line 8—8 thereof;

FIG. 9 is a sectional view of the assembly seen in FIG. 4, the section being taken along line 9—9 thereof; and FIG. 10 is a fragmentary detail view of the rack in the assembly seen in FIG. 4, the rack having a safety bumper guard installed therein.

DETAILED DESCRIPTION OF THE INVENTION

Figure 1:
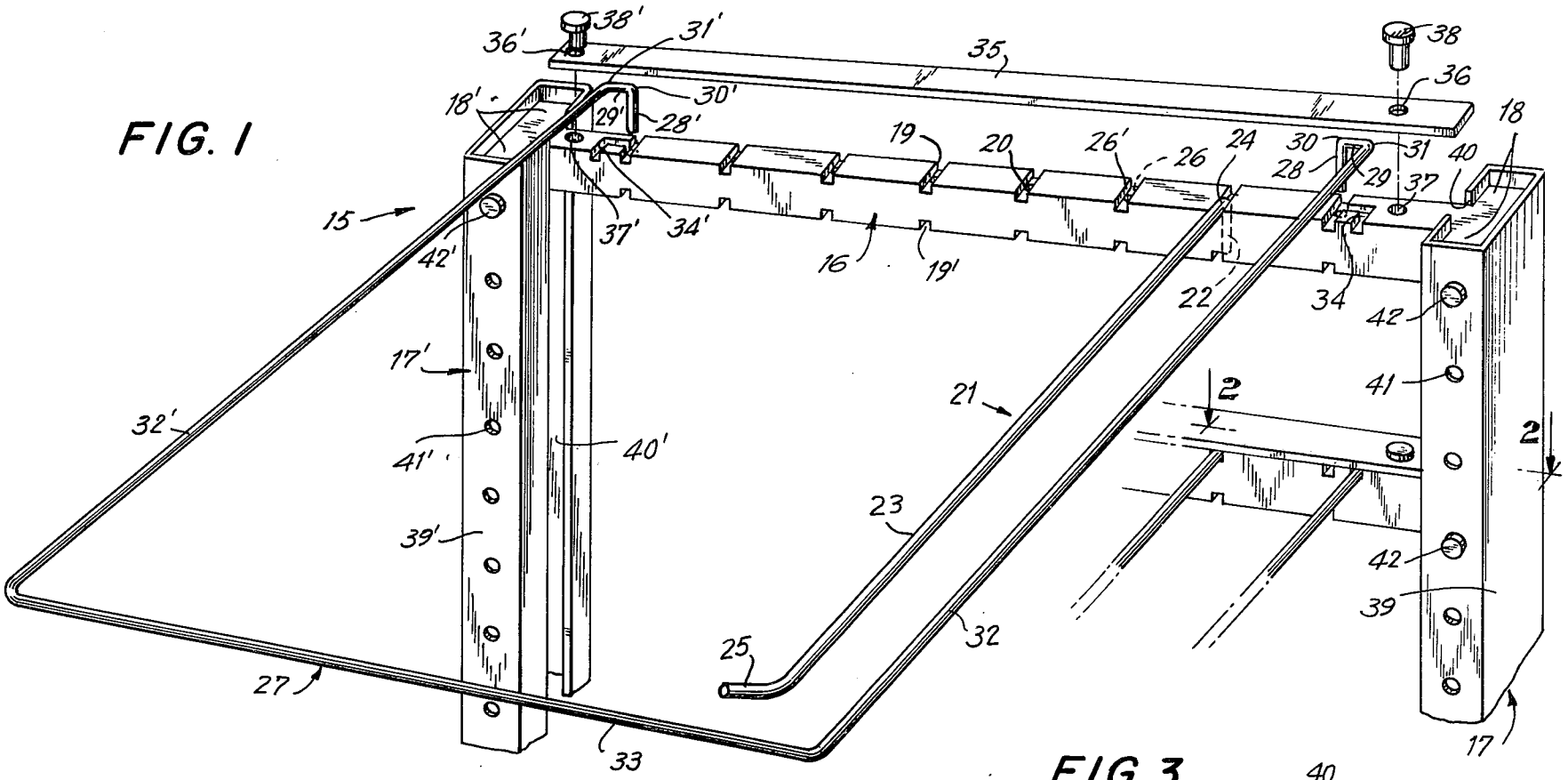
FIG. 1 is a partially exploded perspective view of a vertically adjustable hook display assembly constructed in accordance with the invention.
Figure 3:
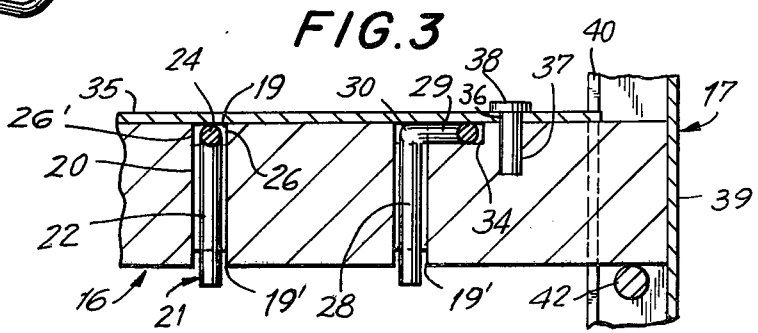
FIG. 3 is a sectional view of the embodiment seen in FIG. 1, the section being taken along line 3—3 thereof.
Figure 2:
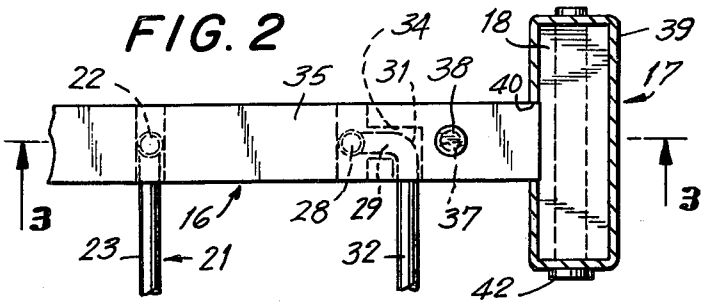
FIG. 2 is a sectional view of the assembly seen in FIG. 1, the section being taken along line 2—2 thereof.
Figure 4:
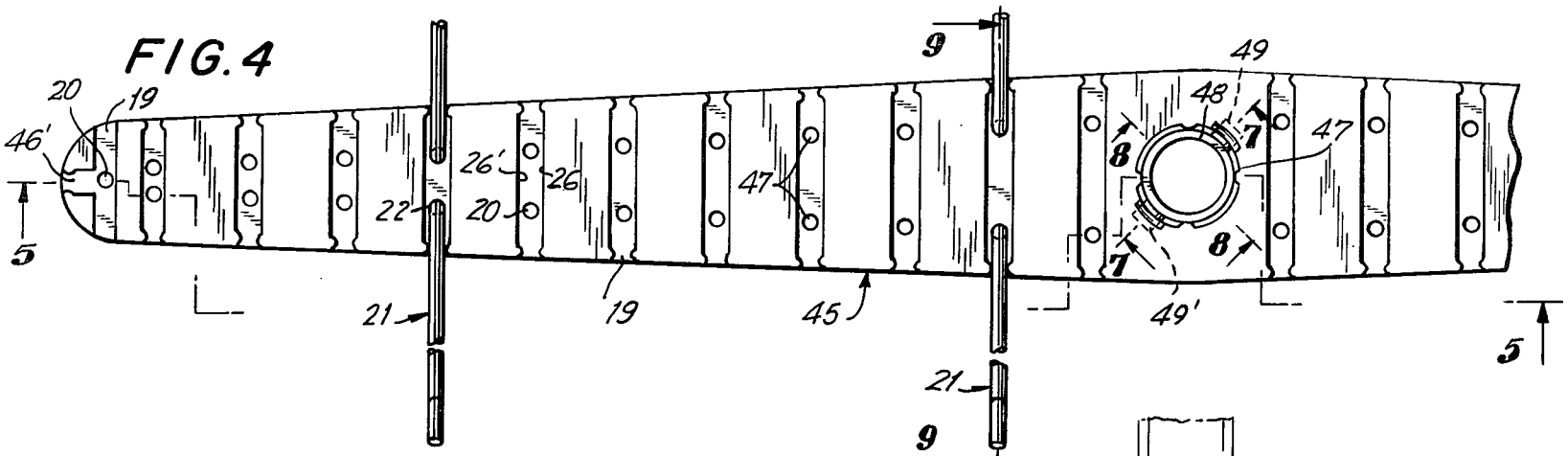
FIG. 4 is a partial top plan view of another embodiment of a display assembly constructed in accordance with the instant invention.

In the FIGS. two embodiments within the scope of the invention are illustrated, one embodiment being illustrated in FIGS. 1-3 and the other being illustrated in FIGS. 4-10. While the constructions of the assemblies disclosed herein are distinguished from those heretofore disclosed in my copending application, the specific constructions of the hook members and safety bumper guards in these novel assemblies may be identical with those heretofore disclosed in that copending application. The modification in the construction of the safety bumper guard for the embodiment seen in FIGS. 4-10 is for the purpose of adapting the safety bumper guard to the construction of the rack in that assembly which may carry bilaterally extending sets of hook members, as described hereinafter in detail.

Referring particularly to FIGS. 1-3 which illustrate one of the embodiments within the scope of the instant invention, a vertically adjustable hook display assembly, generally designated by the numeral 15, includes a rack 16 slidably mounted in a pair of substantially parallel upright channel members 17 and 17' on respective pairs of bosses 18 and 18' fixed on opposite ends of rack 16, the bosses 18 and 18' having cross sections substantially equal to the cross sectional areas of the channels interiorly defined by channel members 17 and 17'. Rack 16 has a substantially rectangular cross section and includes corresponding pluralities of aligned overcut and undercut notches, respectively 19 and 19', located a predetermined distance from each other. In each corresponding pair of notches 19, 19', a through hole 20 is provided substantially medianly therein, the through hole 20 extending widthwise through rack 16. Into each through hole 20, a hook member 21 is releasably connected.

As hereinbefore described in my copending application Ser. No. 480,344, now U.S. Pat. No. 3,939,985, the hook members 21 comprise a shank portion 22 adapted to be removably mounted and extended into a through hole 20, a stem portion 23 integrally connected at one end to shank portion 22 at an elbow 24 and having an offset free end 25. The offset angle between end 25 and stem 23 is acute. Elbow 24 defines the length of hook member 21 which extends into through hole 20. Onto offset end 25, a plurality of blister packs and items packaged in wrappers with headers may be removably mounted on hook members 21, the packs and headers, for instance, being provided with an aperture registrable on hook member 21. Once the goods are suspended on stem 23 of hook member 21, the offset angle in end 25 thereof prevents accidental removal of a pack or wrapper therefrom.

When the shank portion 22 of hook member 21 is mounted in through hole 20, a pair of side walls 26 and 26', which partially define notch 19, restrict hook member 21 and substantially prevent reciprocal movement thereof on shank 22. Rack 16 may be made reversible in its slidable mounting in channel members 17 and 17' by providing the top and bottom faces thereof with means for accomodating bumper guard 27, as hereinafter described.

Pedestrian shoppers are protected from puncture wounds and concussive impacts against hook members 21 by bumper guard 27 which is releasably mounted in rack 16 on a pair of shanks 28 and 28' issuing downwardly from a pair of respectively laterally turned shoulders 29 and 29' at corresponding elbows 30 and 30' in bumper guard 27. At a pair of corresponding elbows 31 and 31', bumper guard 27 issues outwardly on a corresponding pair of substantially parallel arms 32 and 32' towards ends 25 of hook members 21. Beyond the free ends 25 of hook members 21, a connecting member 33 integrally connects arms 32 and 32' of bumper guard 27. The body portion of bumper guard 27 consisting of arms 32, 32' and connecting member 33 is substantially coplanar with mounted hook members 21. As hereinbefore disclosed in my copending application, bumper guard 27 is preferably resilient but flexible in connecting member 33 thereof, so as to prevent impalement upon hook members 21 without causing concussive injury.

Shanks 28 and 28' of bumper guard 27 are respectively engageable in the through holes provided in remote notches 19 of rack 16 and a corresponding mirror image pair of L-shaped channels 34 and 34' are cut into the top surface of rack 16, each integrally connecting with a remote notch 19, for thereby recessively accomodating respective shoulders 29, 29', elbows 31, 31' and incipient portions of arms 32 and 32' of bumper guard 27 as shanks 28 and 28' are respectively introduced into the through holes provided in remote notches 19.

Overlying the top surface of rack 16 is a length of plate 35 having remote apertures 36, 36' respectively registrable with a corresponding pair of blind bores 37, 37' provided in remote ends of rack 16. Plate 35 is releasably connected to rack 16 by a pair of studs 38 and 38' tapped through respective apertures 36, 36' into blind bores 37, 37'.

Channel members 17 and 17' include respective corresponding webs 39 and 39' having respective lengthwise linear slots therein 40 and 40' for vertically adjusting the relative horizontal position of rack 16 in channel members 17 and 17'. Provided in webs 39 and 39' are corresponding respective pairs of pluralities of aligned registered apertures 41 and 41', through which a respective corresponding pair of rods 42 and 42' are slidably fitted to adjustably determine the relative fixed positions of rack 16 in channel members 17 and 17'. As fitted through respective pairs of registered apertures 41 and 41', rods 42 and 42' respectively underly rack 16 thereby providing releasable supports therefor. A plural number of racks 16 may be simultaneously adjustably mounted in channel members 17 and 17' in this manner.

Referring now to the embodiment seen in FIGS. 4–10, wherein like parts as compared with the embodiment seen in FIGS. 1–3 are designated by the same numeral, a rack 45 having an oblong tapered construction includes a plurality of corresponding transverse overcut notches 19 therein, each notch 19 having a respective pair of through holes 20 therein for receiving the shank portion 22 of a pair of oppositely oriented hook members 21 therein. Hook members 21 are stabley contained in notches 19 by side walls 26, 26' thereof in the manner heretofore described.

As best seen in FIGS. 4–6 and 10, remote notches 19 in corresponding remote ends of rack 45 have a single through hole 20 therein for removably mounting a bumper guard 27 thereon. While of like function to bumper guard 27, modifications have been made to bumper guard 27' for the purposes of suiting it to the construction and functional purposes of rack 45. Since hook members 21 may extend bilaterally from rack 45 for the length thereof, bumper guard 27' is constructed so as to surround rack 45. As compared with bumper guard 27 bumper guard 27' includes arms 32'' and 32''' integrally connected at opposite ends to respective corresponding connecting members 33' and 33'''. Substantially medianly located in each arm 32'' and 32''' is a pair of shoulders 29'' and 29''' issuing integrally inwardly therefrom. A respective corresponding pair of shanks 28'' and 28''' issue downwardly from shoulders 29'' and 29''' at respective corresponding elbows 30'' and 30'''. Shanks 28'' and 28''' provide the means for removably mounting bumper guard 27 on rack 45. Communicating with the remote notches 19 in rack 45 which provide the mounting for bumper guard 27' is a pair of respective corresponding linear channels 46 and 46', each channel having a perpendicular orientation relative to its corresponding remote notch 19. An end of each linear channel 46 and 46' extends through a respective corresponding tip of rack 45. As bumper guard 27' is mounted in rack 45 on shanks 28'' and 28''', respective shoulders 29'' and 29''' are releasably seated in respective channels 46 and 46'.

Figure 5:
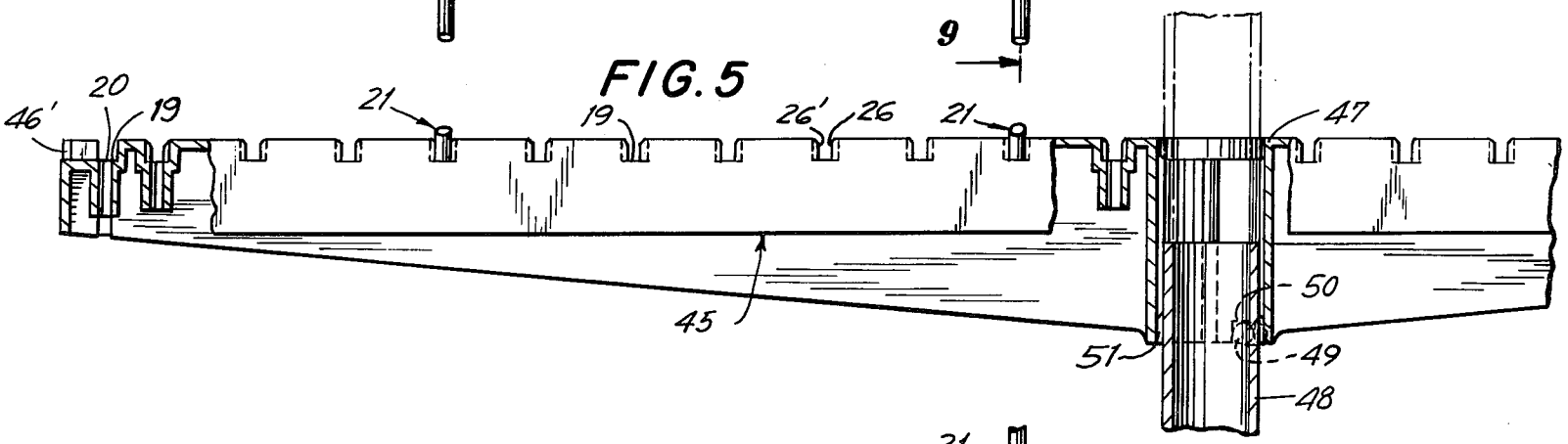
FIG. 5 is a sectional view of the assembly seen in FIG. 4, the section being taken along line 5—5 thereof.
Figure 6:
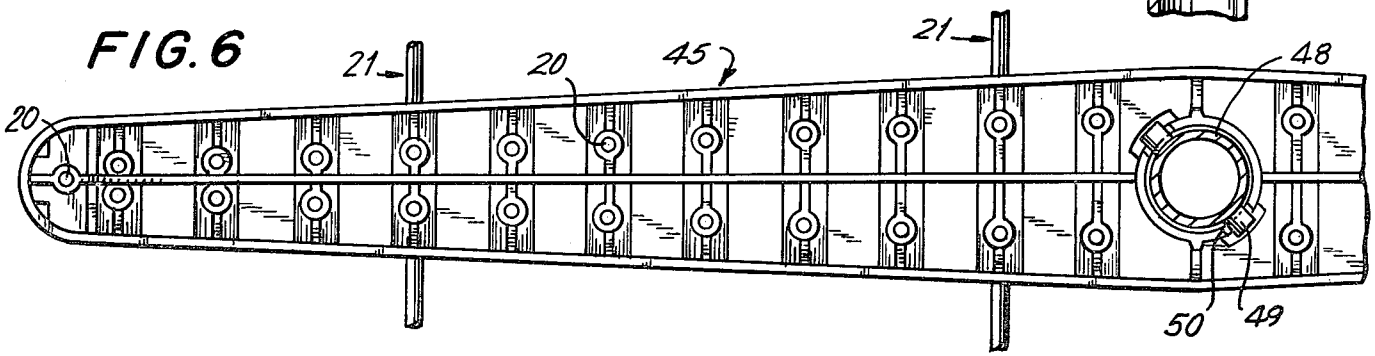
FIG. 6 is a bottom plan view of the assembly seen in FIG. 4.

The mounting for rack 45 comprises a collar and sleeve arrangement including means for stop gapping the horizontally oriented rack at a predetermined vertical position. Located medianly through rack 45 is a collar 47 for slidably mounting rack 45 on a sleeve 48 provided with a pair of diametrically opposed laterally extending nubs 49 and 49' registrable in a corresponding pair of slots 50 and 50' provided in the bottom surface 47' of collar 47. As best seen in FIGS. 5, 7 and 8, collar 47 is slidably overfitted onto sleeve 48 for about half its length before nubs 49, 49' register in slots 50, 50' in collar 47 and thereby prevent reciprocal movement of collar 47 on sleeve 48. Interiorly located within collar 47 are a plurality of axially extending ribs 51 which concentrically align collar 47 on sleeve 48 and frictionally inhibit any sway in rack 45 on sleeve 48.

A second rack 45 mounted identically to the first may be stacked on the first arrangement by nesting the sleeve of the second arrangement into the collar of the first arrangement until the laterally extending nubs in the sleeve of the second arrangement abut into a second pair of slots 50, 50' provided in the top surface 47'' of collar 47. In this manner a nested arrangement of stacked racks 45 may be assembled.

As in my copending application, it is intended that a bumper guard will be used in connection therewith. The bumper guard renders the device safe for use in high population density retail stores and does not detract from the usefulness thereof.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A display assembly comprising a rack, a hook member having a free end mounted to said rack, said rack including a plurality of transverse overcut notches therein, each notch having a pair of holes therein for receiving therein a pair of said hook members, said hook members being oppositely oriented, a safety bumper guard connected to said rack and extending beyond the free ends of said hook members to prevent puncture wounds caused by an encounter with said hook members, said rack having a longitudinal overcut notch located at each end of said rack, each said longitudinal notch having a hole therein for receiving therein said safety bumper guard, a sleeve, said sleeve having at least one laterally extending nub, a collar disposed on said rack, said collar being mounted on said sleeve for slidably mounting said rack on said sleeve, said collar having a bottom surface and having at least one lower slot corresponding to said nub formed therein, said nub being registrable in said slot when said collar is mounted on said sleeve and said collar having a top surface having at least one upper slot formed therein for thereby nesting a second sleeve into said collar until the laterally extending nub thereof nests with said upper slot.

2. A display assembly as claimed in claim 1, wherein said collar is slidably overfitted onto said sleeve and an end of said sleeve terminates within said collar when said nub engages said lower slot.

3. A display assembly as claimed in claim 1, and further including a plurality of axially extending ribs located within said collar for concentrically aligning said collar on said sleeve and frictionally inhibiting any sway in said rack on said sleeve.

4. A display assembly as claimed in claim 1, wherein said collar has diametrically opposed lower and upper slots for engagement with nubs on mating sleeves.

* * * * *